US008400315B1

(12) United States Patent
Sherman

(10) Patent No.: US 8,400,315 B1
(45) Date of Patent: Mar. 19, 2013

(54) PROCESS UNDER/OVER TEMPERATURE INDICATOR

(75) Inventor: William Sherman, Bellview, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 811 days.

(21) Appl. No.: 12/606,632

(22) Filed: Oct. 27, 2009

Related U.S. Application Data

(60) Provisional application No. 61/108,791, filed on Oct. 27, 2008.

(51) Int. Cl.
*G08B 17/00* (2006.01)

(52) U.S. Cl. ..... 340/584; 340/581; 340/585; 340/588; 340/589; 340/635; 340/870.17; 62/127; 62/130; 219/445.1; 219/446.1

(58) Field of Classification Search ..... 340/584, 340/581, 585, 588, 589, 635, 653, 657, 870.17; 219/445.1, 446.1, 483; 62/127, 130
See application file for complete search history.

(56) References Cited

U.S. PATENT DOCUMENTS

| | | | | |
|---|---|---|---|---|
| 4,345,145 | A * | 8/1982 | Norwood | 219/492 |
| 4,788,398 | A * | 11/1988 | Hornung | 219/483 |
| 5,684,463 | A * | 11/1997 | Diercks et al. | 340/584 |
| 6,043,461 | A * | 3/2000 | Holling et al. | 219/445.1 |
| 6,453,687 | B2 * | 9/2002 | Sharood et al. | 62/127 |

* cited by examiner

*Primary Examiner* — Hung T. Nguyen
(74) *Attorney, Agent, or Firm* — Withrow & Terranova, PLLC

(57) ABSTRACT

An apparatus and method for indicating a process temperature anomaly during a power outage comprising employing a power source separate from that powering the process, setting a temperature set point; sensing presence and absence of power powering the process, sensing process temperature; and indicating to users that an absence of power was sensed and that the temperature sensed during the absence of power was below (or above) the temperature set point.

20 Claims, 2 Drawing Sheets

PROCESS UNDER/OVER TEMPERATURE INDICATOR

CROSS-REFERENCE TO RELATED APPLICATIONS

This application claims priority to and the benefit of the filing of U.S. Provisional Patent Application Ser. No. 61/108,791, entitled "Process Under/Over Temperature Indicator", filed on Oct. 27, 2008, and the specification and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to methods and apparatuses for ensuring that a product or products being manufactured have not fallen out of bake/cure/freeze or like specifications during a power failure event.

2. Description of Related Art

Power outages, such as from lightning strikes, can last from a few minutes to several hours or longer. After a power outage, persons maintaining a production facility usually go around and reset the ovens/freezers/chambers so that the devices can continue the cure/bake-out or similar cycles (sometimes an oven or freezer can be missed, but this is rare) and to make sure that the units are on. If the power outage lasts more than the chamber's insulation can maintain internal temperature (thermal inertia), the process will go out of specification even if maintenance does reset the chamber. Not knowing the chamber's downtime may give a false sense of security when one comes back into work and the chamber is on, which may lead to catastrophic results (e.g., severe delamination while going over a wave solder machine, moisture trapped under a coating thereby causing corrosion, adhesives not bonding properly, and premature failure of the manufactured article (quite possibly in the field), etc.). The present invention provides a direct solution to this problem.

BRIEF SUMMARY OF THE INVENTION

The present invention is of an apparatus and method for indicating a process temperature anomaly during a power outage, comprising: employing a power source separate from that powering the process; setting a temperature set point; sensing presence and absence of power powering the process; sensing process temperature; and indicating to users that an absence of power was sensed and that the temperature sensed during the absence of power was below (or above) the temperature set point.

Further scope of applicability of the present invention will be set forth in part in the detailed description to follow, taken in conjunction with the accompanying drawing, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention is of an apparatus for indicating a process temperature anomaly during a power outage. Because ovens and freezers are often no longer equipped with a chart recorder, an extremely cost-effective device is preferred, both to manufacture and to incorporate into cure/bake-out/freezer procedures. The present invention was designed to be compact, user-friendly, extremely cost-effective to build, and easy to calibrate.

Figure 1:
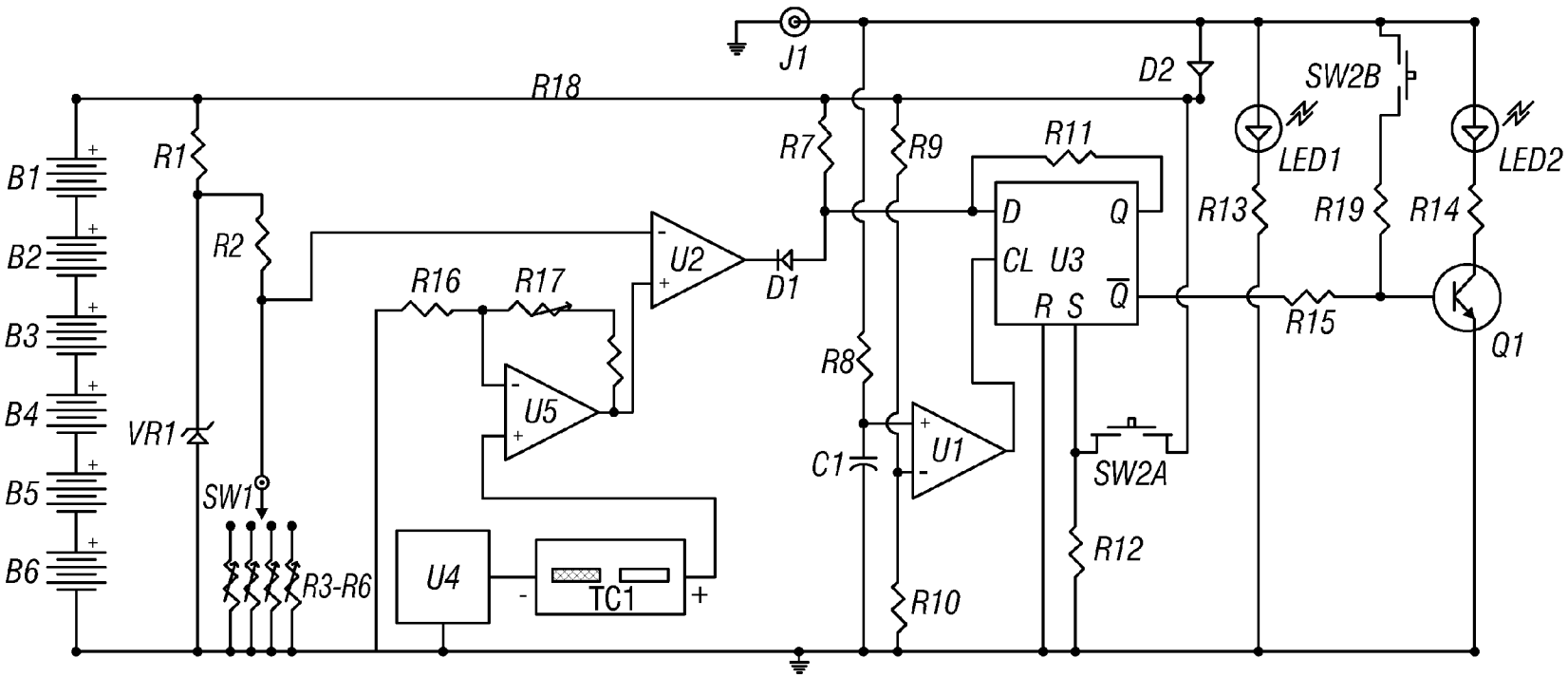
FIG. 1 is a schematic diagram of the preferred sensor and indicator of the invention.
Figure 2:
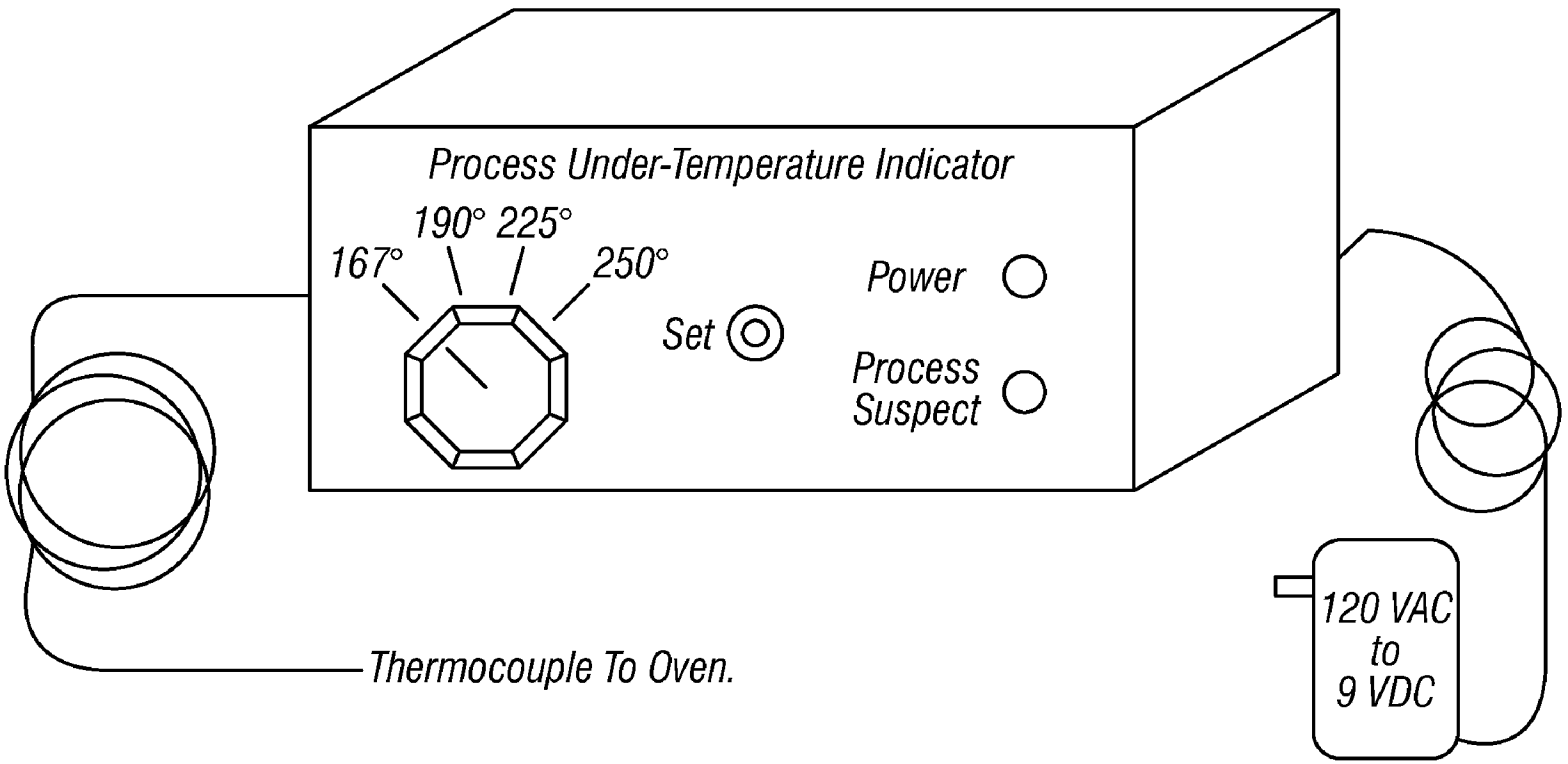
FIG. 2 is a diagram of the preferred front panel of the invention used in conjunction with a four-way switch.

The attached schematic of FIG. 1 shows one embodiment of the present invention for ovens. As shown in FIG. 1, the invention comprises: batteries B1-B6 (preferably 1.5 volt rechargeable); comparators U1-U2 (preferably in dual comparator type LM393); flip-flop U3 (preferably type CD4013); voltage reference VR1 (preferably a type LT1004 voltage reference, or alternatively a Zener diode); switch SW1 (preferably relay type SP4T, but two-way, three-way, or greater can be employed, as well as a hard-wired set point); switch SW2 (preferably momentary type DPDT); jack J1 (preferably matching wall transformer (not shown)); capacitor C1 (for reset time delay); diodes D1-D2 (preferably silicon); transistor Q1 (preferably type 2N2222A); light emitting diodes (LEDs) LED1-LED2; resistors R1-R19; thermocouple cold junction compensator and matched amplifier (preferably type LTK001; improves the low-level signal output of thermocouple and reduces or eliminates non-linearities inherent in them); cold junction compensator U4; amplifier U5; and thermocouple jack TC1. R16-R18 are picked preferably to ensure an approximate desired output of 10 mV/° C. One pole in SW2 is preferably used in conjunction with R19 to add an LED check function. When the user resets the unit, the "Process Suspect" LED (see FIG. 2) will light.

The unit of the invention is preferably powered by a small DC output wall transformer. The exact voltage is not critical, but about 6 to 12 volts is preferred. B1-B6 are used to maintain operation and the flip-flop's (U3) memory state during a power outage. R1 and VR1 are used to act as the stable voltage reference required for the R2/R3-R6 voltage divider that forms one half of the voltage comparators circuit. The other half of the circuit is the input of a thermocouple (Type "T" is preferred) inserted into TC1 with the other end placed into the oven. If the temperature is at or above the minimum temperature (for heating applications; reverse for cooling applications) selected via SW1, the output of U2 will be "High", reversed biasing diode D1, in effect leaving the "D" input of U3 to be driven by the R7/R11 combination (meaning pulled "High").

In the event of a power outage, B1-B6 supply power to U1-U3 and reverse bias D2. With D2 reverse biased, power to LED1 ("Power On") and LED2 ("Process Suspect") is turned off, conserving battery power for the active portion of the circuit. C1 will be discharged via LED1, ensuring a clean reset.

Once power is restored, the reset circuit comprising U1, C1, and R8-R10 transitions from a "Low" to a "High", triggering the "edge-triggered" "D"-type flip-flop clock line (CL) with a time delay determined by ½t the R8/C1 combination.

If the temperature measured by the thermocouple (in millivolts) is below the set point (for heating application, above for cooling) of the R2/R3-R6, U2 will output a "Low" through D1, swamping the "D" input so that when the reset circuit transitions, the "Low" is passed on to the "Q" output of U3. R11 is chosen to be low enough in value to help latch the flip-flop (similar to a Schmidt Trigger) but high enough in resistance to minimize quiescent current drain during a power outage, yet low enough to make the calibration step tolerable.

With U3's "Q" output "Low", the "Q" is now "High", turning on Q1, which in turn turns on LED2 ("Process Suspect"). The flip-flop is now latched in this state and the only way to clear the "Process Suspect" light is by pressing SW2.

The device of the invention is preferably operated as follows. Upon placing the materials for process in an oven and the oven obtaining operating temperature: (1) the operator selects the desired preset temperature via SW1; (2) the operator presses SW2, which sets the "D"-type flip-flop into the known "Set" condition, and which does an illumination "Self-Test" of LED2; (3) with the flip-flop "Set", Q is pulled low, disabling transistor Q1 from driving LED2 ("Process Suspect") and turning the indicator off; and (4) the device is now armed.

If during the bake/cure cycle the power goes off, B1-B6 supply the power for the circuit less the two LEDs. By not powering the two LEDs, battery life is significantly enhanced. Being CMOS based integrated circuits, the supply current is negligible, the LM393 supply current being only 2-3 mA and that of the CD4013 being 2.5 microA unless switching or driving another device. When the operator goes to get the materials for process, if the "Process Suspect" LED is lit, they will know that the materials for process have fallen out of specification and that they need to notify engineering or other appropriate personnel.

The preferred number of batteries depends on the power supply voltage minus the D2 voltage drop and desired estimated needed runtimes (e.g., from about four days to one month).

By reversing the sensing leads on U2 the device of the invention can also serve as an "Over-Temperature" device for use in freezers, thus making the device of the invention useful to not only OEM oven manufacturers but also freezer/cooler makers.

Features and advantages of the invention include: (1) "At-A-Glance" assurance that a power interruption did not disturb the "Bake/Cure" Cycle or that material has not thawed out; (2) Battery Back-Up—when the power went off in the prior art, the chart recorders also stopped working—furthermore, no expensive "Chart Paper" to buy; (3) Easy to use—just verify correct temperature and press the "Set" button; (4) Preferred design monitors four most common bake temperatures in a facility, and this is easily altered to accommodate others and is adaptable to freezers; (5) inexpensive to build—"Peace of Mind" is an added "Bonus"; (6) Easy to maintain and calibrate; and (7) Easily incorporated by OEM Oven/Freezer manufacturers.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An apparatus for indicating a process temperature anomaly during a power outage, said apparatus comprising:
- a power source separate from that powering the process;
- a temperature setting command device;
- a temperature sensor sensing process temperature;
- a power sensor sensing presence and absence of power powering the process; and
- an indicator showing that the power sensor sensed absence of power and that the temperature sensor sensed during the absence of power a temperature below that set by said temperature setting command device.

2. The apparatus of claim 1 wherein said power source comprises one or more batteries.

3. The apparatus of claim 1 wherein said temperature setting command device comprises a switch.

4. The apparatus of claim 3 wherein said temperature setting command device comprises a three-way or greater switch.

5. The apparatus of claim 1 wherein the indicator comprises one or more light emitting diodes.

6. An apparatus for indicating a process temperature anomaly during a power outage, said apparatus comprising:
- a power source separate from that powering the process;
- a temperature setting command device;
- a temperature sensor sensing process temperature;
- a power sensor sensing presence and absence of power powering the process; and
- an indicator showing that the power sensor sensed absence of power and that the temperature sensor sensed during the absence of power a temperature above that set by said temperature setting command device.

7. The apparatus of claim 6 wherein said power source comprises one or more batteries.

8. The apparatus of claim 6 wherein said temperature setting command device comprises a switch.

9. The apparatus of claim 6 wherein said temperature setting command device comprises a three-way or greater switch.

10. The apparatus of claim 6 wherein the indicator comprises one or more light emitting diodes.

11. A method for indicating a process temperature anomaly during a power outage, the method comprising the steps of:
- employing a power source separate from that powering the process;
- setting a temperature set point;
- sensing presence and absence of power powering the process;
- sensing process temperature; and
- indicating to users that an absence of power was sensed and that the temperature sensed during the absence of power was below the temperature set point.

12. The method of claim 11 wherein the power source comprises one or more batteries.

13. The method of claim 11 wherein the setting step comprises employing a switch.

14. The method of claim 13 wherein the setting step comprises employing a three-way or greater switch.

15. The method of claim 11 wherein the indicating step comprises lighting one or more light emitting diodes.

16. A method for indicating a process temperature anomaly during a power outage, the method comprising the steps of:

employing a power source separate from that powering the process;

setting a temperature set point;

sensing presence and absence of power powering the process;

sensing process temperature; and indicating to users that an absence of power was sensed and that the temperature sensed during the absence of power was above the temperature set point.

17. The method of claim 16 wherein the power source comprises one or more batteries.

18. The method of claim 16 wherein the setting step comprises employing a switch.

19. The method of claim 18 wherein the setting step comprises employing a three-way or greater switch.

20. The method of claim 16 wherein the indicating step comprises lighting one or more light emitting diodes.

* * * * *